US006044751A

United States Patent [19]

Kimura et al.

[11] Patent Number: 6,044,751

[45] Date of Patent: Apr. 4, 2000

[54] VARIABLE DISPLACEMENT COMPRESSOR

[75] Inventors: Kazuya Kimura; Hiroaki Kayukawa; Hideki Mizutani; Shigeyuki Hidaka, all of Kariya, Japan

[73] Assignee: Kabushiki Kaisha Toyoda Jidoshokki Seisakusho, Japan

[21] Appl. No.: 09/221,055

[22] Filed: Dec. 28, 1998

[30] Foreign Application Priority Data

Dec. 26, 1997 [JP] Japan ..... 9-361260

[51] Int. Cl.[7] ..... F01B 3/00

[52] U.S. Cl. ..... 92/71; 417/269

[58] Field of Search ..... 92/12.2, 57, 71; 417/269

[56] References Cited

U.S. PATENT DOCUMENTS

| | | | |
|---|---|---|---|
| 4,174,191 | 11/1979 | Roberts | 417/269 X |
| 4,846,049 | 7/1989 | Terauchi | 92/12.2 |
| 4,979,877 | 12/1990 | Shimizu | 417/269 X |
| 5,385,450 | 1/1995 | Kimura et al. | 417/269 |
| 5,407,328 | 4/1995 | Kimura et al. | 417/269 X |
| 5,529,461 | 6/1996 | Kawaguchi et al. | 417/269 X |

FOREIGN PATENT DOCUMENTS

| | | |
|---|---|---|
| 4-159464 | 6/1992 | Japan . |
| 5-106552 | 4/1993 | Japan . |
| 7-91366 | 4/1995 | Japan . |

*Primary Examiner*—Hoang Nguyen
*Attorney, Agent, or Firm*—Woodcock Washburn Kurtz Mackiewicz & Norris LLP

[57] ABSTRACT

A variable displacement compressor including a housing assembly, a drive shaft rotatably supported in the housing assembly, a cam plate provided at a generally center thereof with a through hole, through which the drive shaft extends, and provided in a wall surface of the through hole with a support portion abutted onto the drive shaft to establish a slidable support for the cam plate on the drive shaft, a joint mechanism for connecting the cam plate with the drive shaft to rotate the cam plate together with the drive shaft, a piston engaged with the cam plate to be reciprocated in a cylinder due to a rotation of the cam plate, a control mechanism for changing an inclination of the cam plate on the drive shaft to adjust a compressor displacement, and a friction reducing coating layer for reducing friction force caused between the drive shaft and the support portion of the cam plate during an operation for adjusting the compressor displacement. The friction reducing coating layer is provided on the wall surface of the through hole to lower a coefficient of friction of the support portion.

9 Claims, 5 Drawing Sheets

VARIABLE DISPLACEMENT COMPRESSOR

BACKGROUND OF THE INVENTION

1. Field of the Invention

The present invention relates generally to a compressor and, more particularly, to a variable displacement compressor which can optimize a compression ratio of a hydraulic fluid and adjust a compressor displacement.

2. Description of the Related Art

A variable displacement compressor which can optimize a compression ratio of a hydraulic fluid and adjust a compressor displacement by varying a stroke of a piston in the compressor has been well known in the art, and is commonly used as a refrigerant compressor in an air conditioning system of, e.g., a vehicle. One example of conventional variable displacement compressors is disclosed in Japanese Unexamined Patent Publication (Kokai) No. 7-91366 (JP-A-7-91366), and FIG. 5 shows the main parts of this example.

As shown in FIG. 5, the variable displacement compressor disclosed in JP-A-7-91366 includes a housing 101, a drive shaft 102 rotatably supported in the housing 101, a rotor element 103 fixed on the drive shaft 102 for rotation together with the drive shaft 102, a swash plate 104 as a cam plate carried on the drive shaft 102, and plural single headed pistons 106 (only one piston 106 is shown) housed inside respective cylinder bores 101*a* (only one cylinder bore 101*a* is shown). The swash plate 104 is provided with a center through hole 105 through which the drive shaft 102 extends, and is operatively connected with the rotor element 103 through a joint mechanism 109. The swash plate 104 is also operatively engaged with the pistons 106 through respective pairs of hemispherical shoes 108 to reciprocate the pistons 106 in the cylinder bores 101*a* due to the rotation of the swash plate 104.

The joint mechanism 109 includes a guide pin 110 formed on the swash plate 104 to project obliquely from a front surface 104*a* (or a left surface in the figure) of the swash plate 104. The guide pin 110 is substantially located along a certain radius line "D" of the swash plate 104, the radius line "D" being specified so that one piston 106 is positioned at a top dead center thereof when the swash plate 104 is engaged with this piston 106 along the radius line "D". The guide pin 110 is provided at the distal end thereof with a generally spherical head 110*a*.

The joint mechanism 109 also includes a support arm 111 formed on the rotor element 103 to project from the upper end portion of the rotor element 103 toward the swash plate 104. The support arm 110 is provided with a guide hole 111*a*, the axis of which extends obliquely in relation to a rotation axis "L" of the drive shaft 102. The guide pin 110 is inserted into the guide hole 111*a*, and the generally spherical head 110*a* of the guide pin 110 is slidably engaged with the inner wall surface of the guide hole 111*a*.

The center through hole 105 of the swash plate 104 is provided with a support portion 105*a* on the inner wall surface of the center hole 105 to provide a slidable support for the swash plate 104 on the drive shaft 102. The support portion 105*a* is defined at a certain position opposite to the joint mechanism 109 in relation to the rotation axis "L" of the drive shaft 102. The support portion 105*a* is also formed at an apex of the inner wall surface of the center hole 105, and includes a generally arcuate surface extending about a lateral axis "S" in a vertical section as shown in FIG. 5.

The swash plate 104 is operatively connected through the joint mechanism 109 and the rotor element 103 to the drive shaft 102 and thus can rotate together with the drive shaft 102 in the housing 101. The rotating motion of the swash plate 104 due to the rotation of the drive shaft 102 is converted to the reciprocating motion of the pistons 106 in the cylinder bores 101*a* in a direction parallel to the axis "L" of the shaft 102 through the sliding engagement in the shoes 108, so that a hydraulic fluid, such as a refrigerant, is intermittently compressed in the cylinder bores lOla.

The swash plate 104 can also be shifted on the drive shaft 102 to change the inclination of the swash plate 104 relative to the rotation axis "L" of the shaft 102, under the slidable guide for the spherical head 110*a* of the guide pin 110 in the guide hole 111*a* of the support arm 111 in the joint mechanism 109, and also under the slidable support for the swash plate 104 on the drive shaft 102 at the support portion 105*a* in the swash plate center hole 105. When the inclination of the swash plate 104 is changed, the stroke of each piston 106 is varied, and thereby the compression ratio of the hydraulic fluid is optimized or the displacement of the compressor is adjusted.

During the operation of the compressor, the piston 106 is subjected to a compressive load "K" due to the compression of the hydraulic fluid or refrigerant gas, and the compressive load "K" is applied to the inner wall surface of the guide hole 111*a*, on a front side (or a left side in the figure) away from the swash plate 104, through the shoes 108, the swash plate 104 and the head 110*a* of the guide pin 110. Then, the reaction force "F" is applied to the head 110*a* of the guide pin 110 from the inner wall surface of the guide hole 111*a*. In this respect, the guide hole 111*a* extends obliquely relative to the axis "L" of the drive shaft 102, that is, one open end of the guide hole 111*a* opposed to the shaft 102 is located nearer the front surface 104*a* of the swash plate 104 than another open end of the guide hole 111*a*. Therefore, the reaction force "F" applied to the guide pin 110 acts to bias the swash plate 104 in a direction "f" toward the joint mechanism 109 in relation to the drive shaft 102. In this manner, during the operation of the compressor, the support portion 105*a* in the center hole 105 of the swash plate 104 is continuously urged onto the outer circumferential surface of the drive shaft 102.

When the displacement of the compressor is adjusted, the swash plate 104 is shifted in a sliding manner on the drive shaft 102 to change the inclination of the swash plate 104 relative to the shaft 102, while the support portion 105*a* of the swash plate 104 is urged onto and slidably engaged with the outer circumferential surface of the shaft 102. In this shifting motion, the swash plate 104 is also tilted or rotated about the lateral axis "S" of the arcuate surface of the support portion 105*a*.

As described above, in the compressor disclosed in JP-A-7-91366, the swash plate 104 is supported on and guided along the drive shaft 102 through the slidable support due to the support portion 105*a* in the center hole 105. This structure serves to reduce the number of parts, such as a sleeve slidably provided on the shaft and pivot pins formed on the sleeve to pivotably support the swash plate, which has been used for the slidable support between the drive shaft and the swash plate in the other conventional compressor (e.g., a compressor disclosed in Japanese Unexamined Patent Publication (Kokai) No. 4-159464), and thereby serves to decrease the production cost and to ease stock management.

On the other hand, in the compressor disclosed in JP-A-7-91366, the support portion 105*a* of the swash plate 104 is firmly urged and contacted under pressure onto the outer circumferential surface of the drive shaft 102 during the operation of the compressor. In this respect, the arcuate surface of the support portion 105*a* is formed by machining or milling the center hole 105 of the swash plate 104, and thereby a machined metallic surface is exposed on the support portion 105*a*. The machined surface of the support portion 105*a* has a relatively large coefficient of friction, and thus tends to increase a friction force caused between the drive shaft 102 and the support portion 105*a* during the shifting motion of the swash plate 104 to adjust the displacement. Consequently, it is difficult to smoothly shift or tilt the swash plate 104 on the drive shaft 102, which may deteriorate the responsibility of the adjustment of the compressor displacement.

SUMMARY OF THE INVENTION

It is therefore an object of the present invention to provide a variable displacement compressor which can decrease a friction force caused between a drive shaft and a swash or cam plate during the adjustment of a compressor displacement.

It is another object of the present invention to provide a variable displacement compressor which can improve the responsibility of the adjustment of the compressor displacement.

In accordance with the present invention, there is provided a variable displacement compressor comprising a housing assembly having at least one cylinder; a drive shaft rotatably supported in the housing assembly; a cam plate arranged in the housing assembly and provided at a generally center thereof with a through hole, through which the drive shaft extends, the cam plate being provided in a wall surface of the through hole with a support portion abutted onto the drive shaft to establish a slidable support for the cam plate on the drive shaft; a joint mechanism for connecting the cam plate with the drive shaft to rotate the cam plate together with the drive shaft, the joint mechanism permitting the cam plate to shift on the drive shaft to change an inclination of the cam plate relative to the drive shaft; at least one piston respectively accommodated in the at least one cylinder and engaged with the cam plate to be reciprocated in the cylinder due to a rotation of the cam plate; a control mechanism for changing the inclination of the cam plate on the drive shaft to adjust a compressor displacement; and a friction reducing means for reducing a friction force caused between the drive shaft and the support portion of the cam plate during an operation for adjusting the compressor displacement.

In a preferred aspect of the invention, the friction reducing means includes a coating layer provided on the wall surface of the through hole of the cam plate to coat the support portion therewith, the coating layer lowering a coefficient of friction of the support portion abutted onto the drive shaft.

In this arrangement, it is preferred that the coating layer has a coefficient of friction lower than that of the wall surface of the through hole.

The coating layer may be formed by plating the wall surface of the through hole.

Alternatively, the coating layer may be formed by coating the wall surface of the through hole with fluorine-contained polymers.

The coating layer is formed substantially entirely on the wall surface of the through hole.

Alternatively, the coating layer may be formed locally on the support portion.

It is preferred that the support portion of the cam plate includes a generally arcuate surface extending about an axis located opposite to the joint mechanism in relation to the drive shaft.

Also, it is preferred that the drive shaft includes a flange portion rotating together with the drive shaft in the housing assembly, and that the joint mechanism includes an arm extending from the cam plate to be slidably and pivotably engaged with the flange portion of the drive shaft and a guide member for guiding the arm on the flange portion in a direction permitting the cam plate to change the inclination on the drive shaft.

In this arrangement, the arm may include a guiding projection projecting from the arm, and the flange portion may include a guiding recess disposed frontward or backward of the arm in view of a rotation direction of the cam plate for receiving and guiding the guiding projection.

BRIEF DESCRIPTION OF THE DRAWINGS

The above and other objects, features, and advantages of the present invention will become more apparent from the following description of preferred embodiments in connection with the accompanying drawings, in which.

DESCRIPTION OF THE PREFERRED EMBODIMENT

Figure 1:
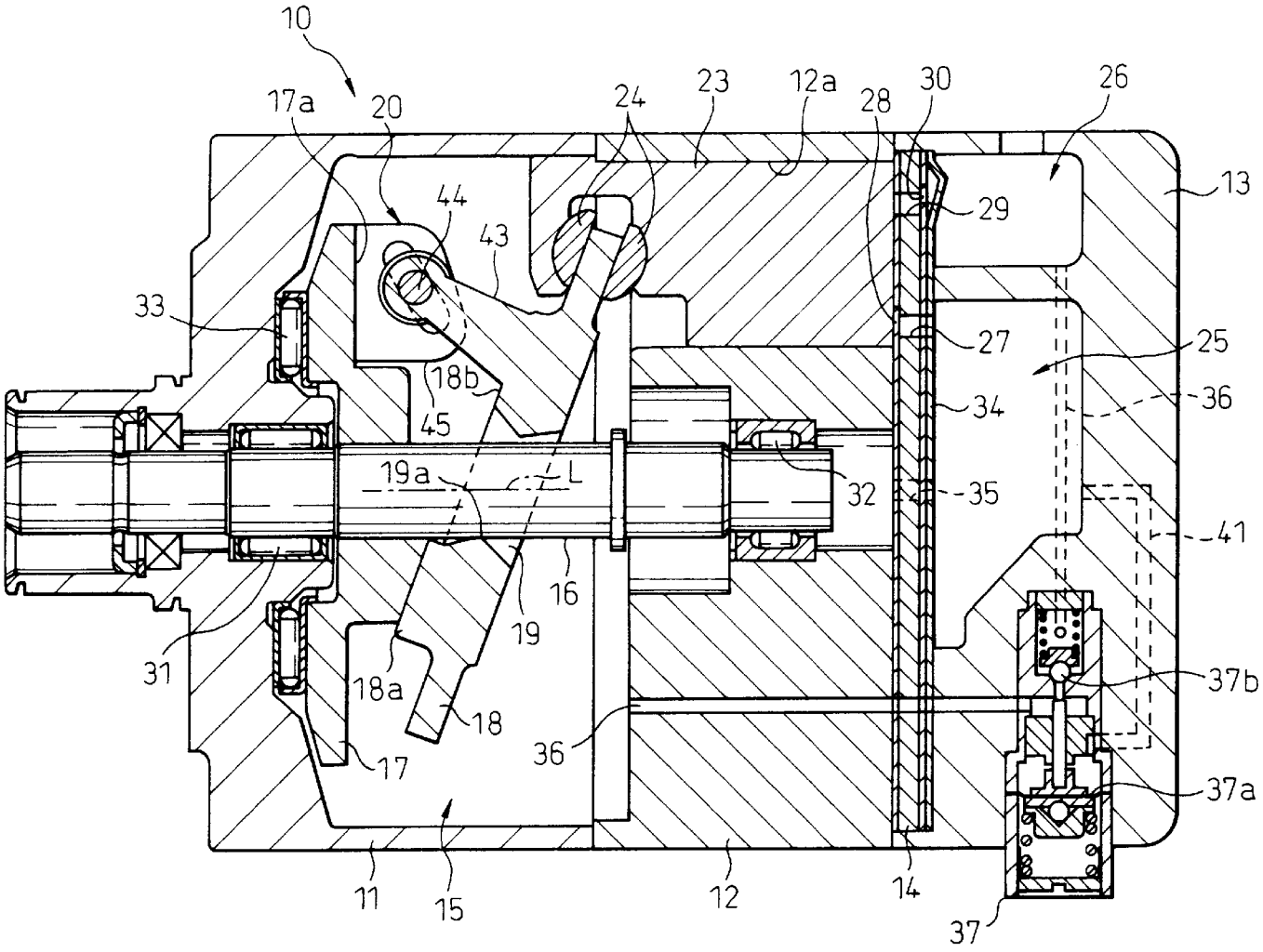
FIG. 1 is a vertical sectional view of one embodiment of a variable displacement compressor according to the present invention.

Referring now to the drawings, in which the same or similar components are denoted by the same reference numerals, FIG. 1 shows one embodiment of a variable displacement compressor 10 according to the present invention. The variable displacement compressor 10 of this embodiment may be used as a refrigerant compressor having single headed pistons, in an air conditioning system of, e.g., a vehicle.

The variable displacement compressor 10 includes a housing assembly, a drive shaft 16 rotatably supported in the housing assembly, a rotor element 17 fixed on the drive shaft 16 for rotation together with the drive shaft 16, a swash plate 18 carried on the drive shaft 16, and plural single headed pistons 23 (only one piston 23 is shown) slidably fitted inside respective cylinder bores 12*a* (only one cylinder bore 12*a* is shown). The housing assembly includes a front housing 11, a cylinder block 12 and a rear housing 13, axially combined with each other. The front housing 11 is securely joined to a front end (a left end in the figure) of the cylinder block 12 to define a crank chamber 15 therebetween. The rear housing 13 is securely joined to a rear end (a right end in the figure) of the cylinder block 12 with a valve assembly 14 being held therebetween. The cylinder bores 12*a* are formed in the cylinder block 12 and are spaced in a circumferential direction with each other about a rotation axis "L" of the drive shaft 16.

The drive shaft 16 extends through the crank chamber 15, and is rotatably supported by a front bearing 31 arranged in the front housing 11 and by a rear bearing 32 arranged in the cylinder block 12. The drive shaft 16 is connected at the front end thereof to an outside drive source, such as a vehicle engine (not shown), through a clutch mechanism, such as an electromagnetic clutch (not shown). Accordingly, the drive shaft 16 rotates when the clutch mechanism is actuated to connect the operating drive source to the drive shaft 16.

The rotor element 17, as a flange portion, fixed on the drive shaft 16 is disposed inside the crank chamber 15, and is rotatably supported by a bearing 33 on the front housing 11 for rotation in the crank chamber 15. The swash plate 18, as a cam plate, is also disposed inside the crank chamber 15, and is provided generally at a center of the swash plate with a center through hole 19, through which the drive shaft 16 extends. The swash plate 18 is operatively connected with the rotor element 17 through a joint mechanism 20. The swash plate 18 is also operatively engaged at the outer peripheral region thereof with the pistons 23 through respective pairs of hemispherical shoes 24. The shoes 24 establish a slidable and tiltable engagement between the swash plate 18 and the pistons 23, so that the pistons 23 are reciprocated in the cylinder bores 12*a* due to the rotation of the swash plate 18.

Figure 2A:
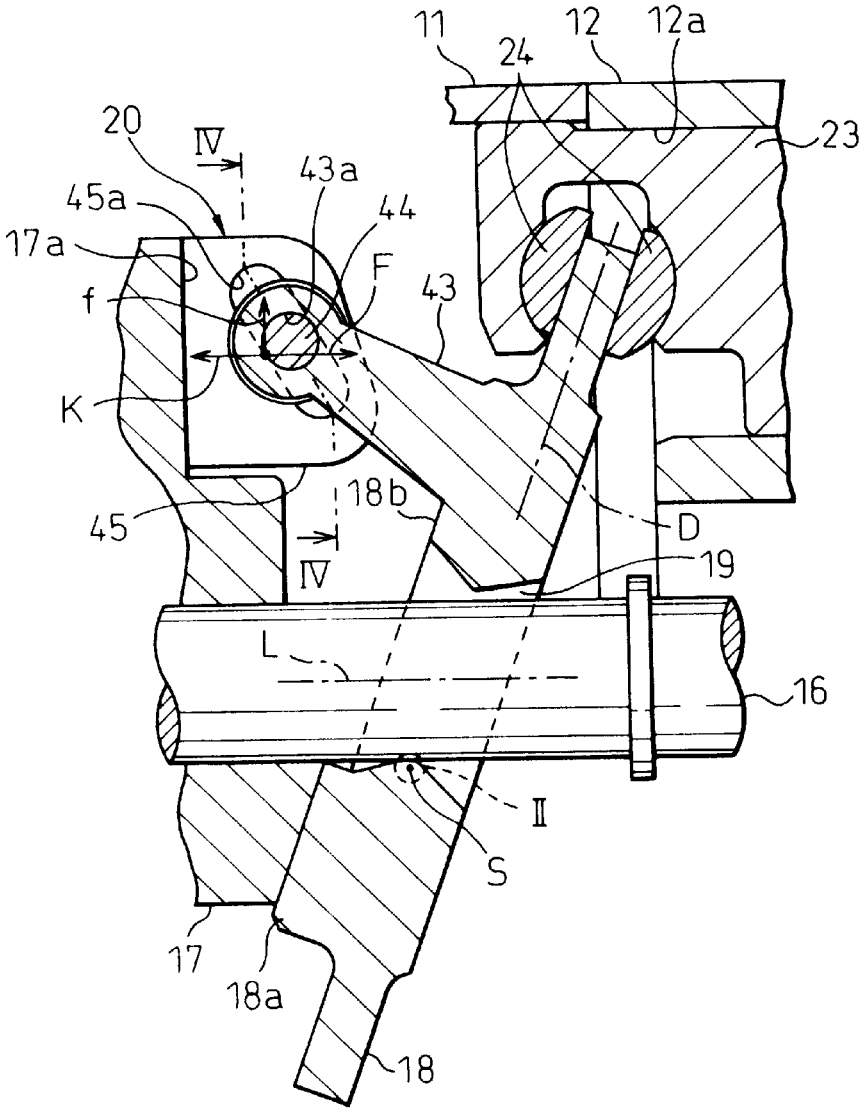
FIG. 2A is an enlarged view showing main parts of the compressor of FIG. 1 in a maximum displacement state.

The center through hole 19 of the swash plate 18 is provided with a support portion 19*a* in the inner wall surface of the center hole 19 to provide a slidable support for the swash plate 18 on the drive shaft 16. The center through hole 19 is formed by certain steps as follows. First, a cylindrical bore is formed at the center of a swash plate workpiece by machining or drilling the workpiece. Then, an end mill having substantially the same diameter as the cylindrical bore is inserted into the bore, and is driven to machine the inner surface of the bore. During this step, the end mill is alternately tilted forward and backward about a lateral axis "S" in a range of a predetermined angle, the lateral axis "S" being defined at a certain position adapted to be opposite to the joint mechanism 20 in relation to the rotation axis "L" of the drive shaft 16 in a vertical section as shown in FIG. 2A. In this manner, the support portion 19*a*, including a generally arcuate surface extending about the lateral axis "S", is formed in the inner wall surface of the center hole 19 at a certain position adapted to be opposite to the joint mechanism 20 in relation to the rotation axis "L" of the drive shaft 16.

Figure 4:
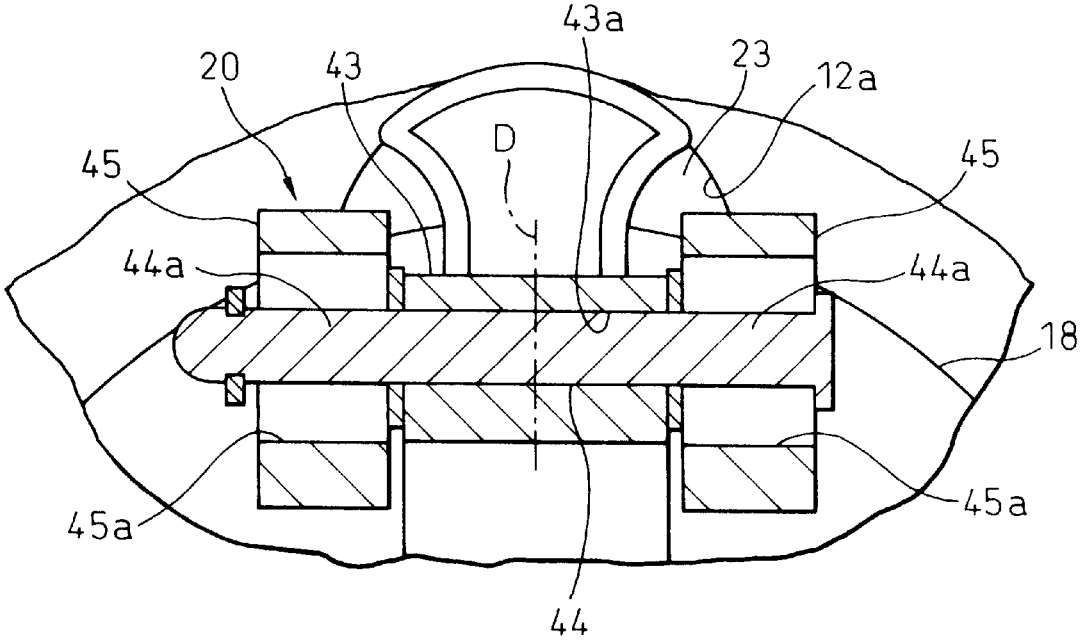
FIG. 4 is an enlarged sectional view taken along a line IV—IV of FIG. 2A.

The joint mechanism 20 includes a swing arm 43 formed on the swash plate 18 to project obliquely from a front surface 18*b* (or a left surface in the figure) of the swash plate 18. As shown in FIGS. 2A and 4, the swing arm 43 is substantially located along a certain radius line "D" of the swash plate 18, the radius line "D" being specified so that one piston 23 is positioned at a top dead center thereof when the swash plate 18 is engaged with this piston 23 along the radius line "D". The swing arm 43 extends toward the rotor element 17 along the rotation axis "L", and is provided at the distal end thereof with a through hole 43*a* extending perpendicularly to both the rotation axis "L", and the radius line "D". One guide pin 44 is press-fitted into the through hole 43*a* to be fixed to the swing arm 43. Both ends 44*a* of the guide pin 44 project from the lateral opposite surfaces of the swing arm 43.

The joint mechanism 20 also includes a pair of support arms 45 formed on the rotor element 17 to project from the upper end portion of the rear surface 17*a* of the rotor element 17 toward the swash plate 18. The support arms 45 are located at symmetrical positions in relation to the radius line "D" of the swash plate 18. Thus, the swing arm 43 is inserted and arranged between the support arms 45, and the support arms 45 are disposed frontward and backward of the swing arm 43 in view of the rotation direction of the swash plate 18. Each support arm 45 is provided with a guide hole 45*a* shaped as an oblong hole. Each guide hole 45*a* extends obliquely in relation to the rotation axis "L" of the drive shaft 16, that is, one longitudinal end surface of the guide hole 45*a* opposed to the shaft 16 is located nearer the front surface 18*a* of the swash plate 18 than another longitudinal end surface of the guide hole 45*a*. The ends 44*a* of the guide pin 44 are respectively inserted into the corresponding guide holes 45*a* of the support arms 45, and the outer surface of the guide pin 110 is slidably engaged with the inner wall surfaces of the guide holes 45*a*.

Figure 5:
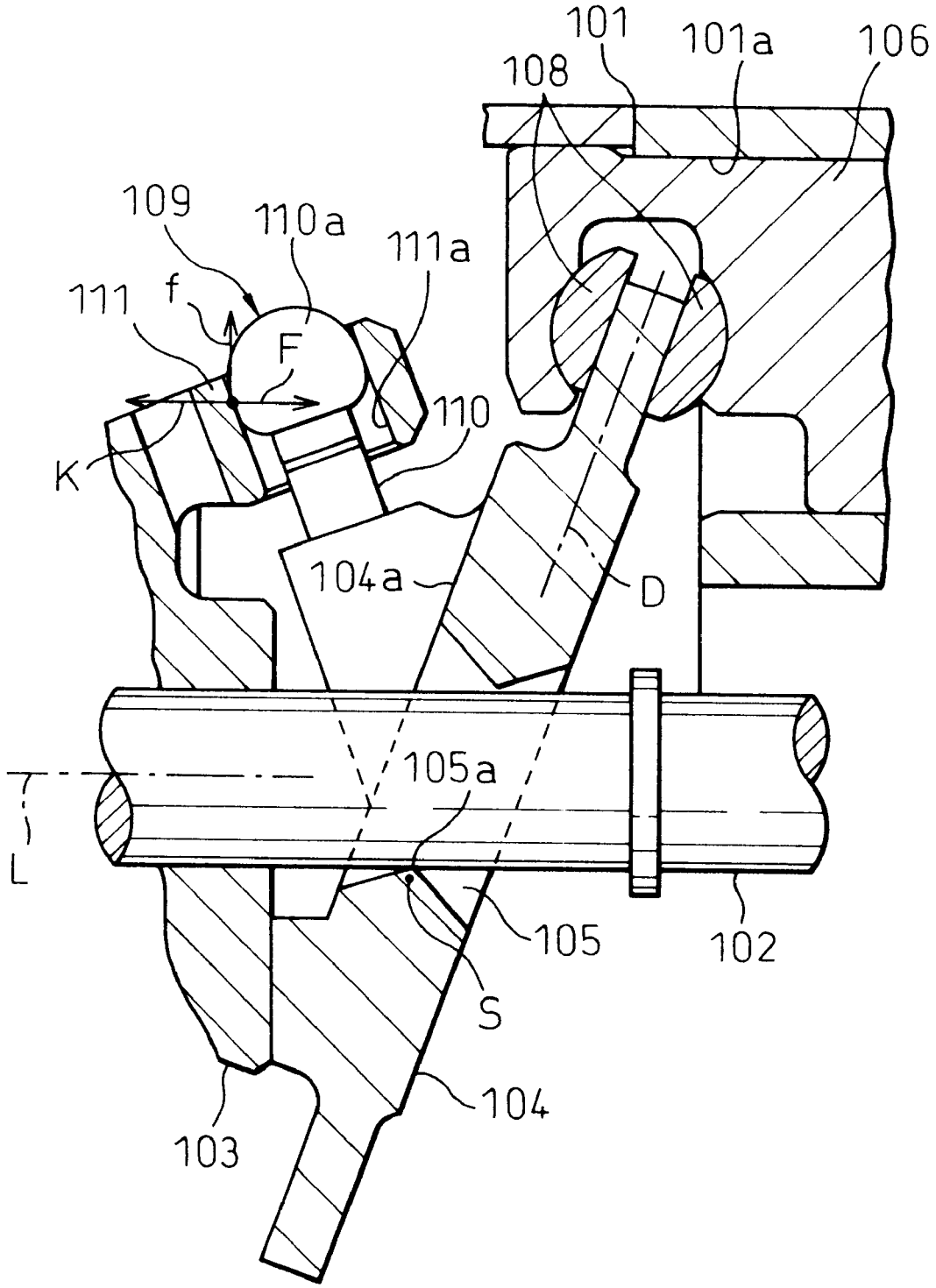
Fig. 5 PRIOR ART
FIG. 5 is an enlarged vertical sectional view showing main parts of a conventional variable displacement compressor.

It should be noted that the joint mechanism 20 may include any guiding projection, in place of the guide pin 44, projecting from at least one lateral surface of the swing arm 43, and any guiding recess, in place of the guide holes 45*a*, formed in at least one support arm 45 disposed frontward or backward of the swing arm 43 in view of the rotation direction of the swash plate 18 for receiving the distal end of the guiding projection and guiding the latter. Also, in the variable displacement compressor 10, the joint mechanism 20 may be replaced by the joint mechanism 109 used in the conventional variable displacement compressor shown in FIG. 5. However, the joint mechanism 20 serves to further improve the response of the operation for adjusting the displacement of the compressor 10.

Referring again to FIG. 1, a suction chamber 25 is defined between the rear housing 13 and the valve assembly 14 at a generally center region of the rear housing 13. A discharge chamber 26 is also defined between the rear housing 13 and the valve assembly 14 at a radially outer region of the rear housing 13. The valve assembly 14 includes a valve plate provided with plural suction ports 27 (only one suction port 27 is shown) for fluidly communicating the suction chamber 25 with the respective cylinder bores 12*a*, and plural discharge ports 29 (only one discharge port 29 is shown) for fluidly communicating the discharge chamber 26 with the respective cylinder bores 12*a*. The valve assembly 14 also includes a suction valve member 28 interposed between the valve plate and the cylinder block 12, and a discharge valve member 30 and a gasket 34, both interposed between the valve plate and the rear housing 13. The suction valve member 28 acts to selectively open/close the suction ports 27, and the discharge valve member 30 acts to selectively open/close the discharge ports 29. The gasket 34 is provided with plural valve retainers.

Figure 3A:
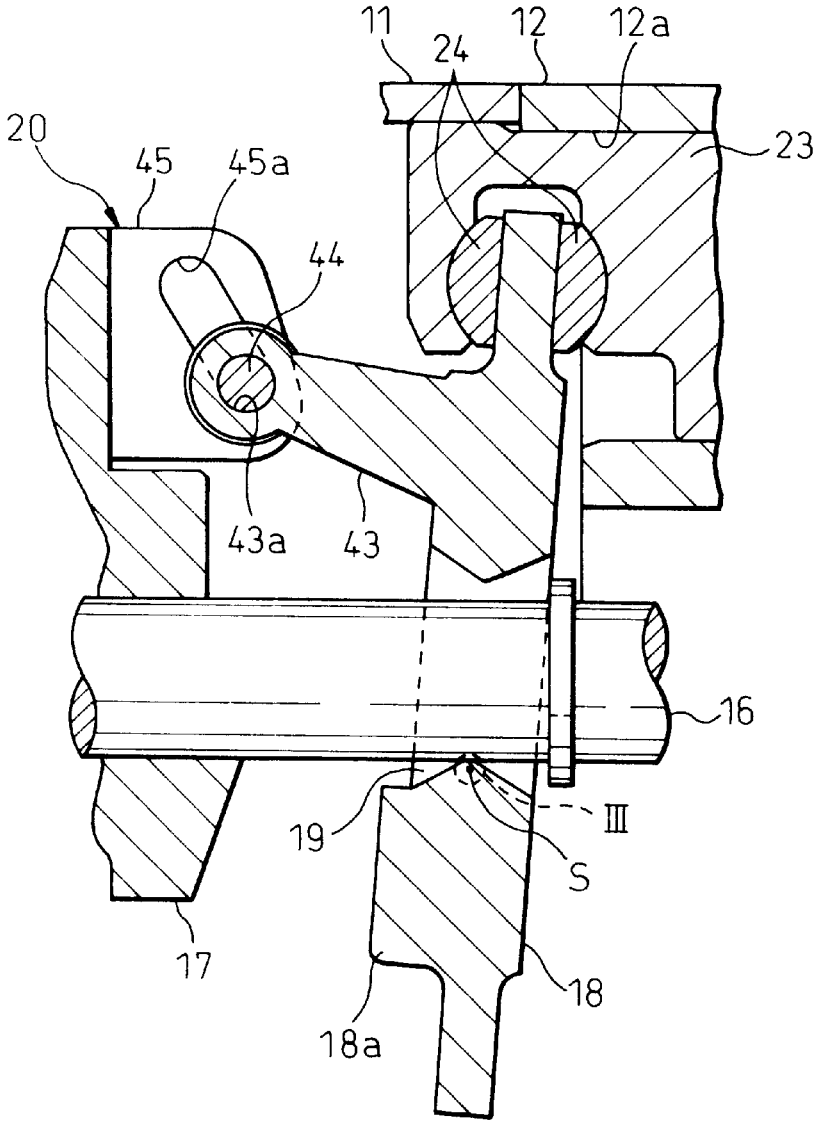
FIG. 3A is an enlarged view showing main parts of the compressor of FIG. 1 in a minimum displacement state.

The swash plate 18 is operatively connected through the joint mechanism 20 and the rotor element 17 to the drive shaft 16 and thus can rotate together with the drive shaft 16 in the crank chamber 15. The rotating motion of the swash plate 18 due to the rotation of the drive shaft 16 is converted to the reciprocating motion of the pistons 23 in the cylinder bores 12*a* in a direction parallel to the axis "L" of the shaft 16 through the sliding engagement in the shoes 24, so that hydraulic fluid, such as refrigerant gas, is intermittently compressed in the cylinder bores 12*a*. FIGS. 2A and 3A show such a condition that the swash plate 18 is engaged with one piston 23 along the radius line "D" and thereby this piston 23 is positioned at the top dead center thereof in the corresponding cylinder bore 12*a*. When the swash plate 18 rotates in an angle of 180 degrees from the condition shown in FIGS. 2A and 3A, the illustrated piston 23 is positioned at a bottom dead center thereof.

Accordingly, when the piston 23 is shifted from the top dead center to the bottom dead center in the corresponding cylinder bore 12*a*, the hydraulic fluid, such as refrigerant gas, in the suction chamber 25 is sucked through the corresponding suction port 27 and suction valve member 28 into the cylinder bore 12*a*. The hydraulic fluid inhaled into the cylinder bore 12*a* is compressed therein when the piston 23 is shifted from the bottom dead center to the top dead center, and is discharged through the corresponding discharge port 29 and discharge valve member 30 to the discharge chamber 26.

The swash plate 18 can be shifted on the drive shaft 16 to change the inclination of the swash plate 18 relative to the rotation axis "L" of the shaft 16, under the slidable guide for the ends 44*a* of the guide pin 44 in the guide holes 45*a* of the support arms 45 in the joint mechanism 20, and also under the slidable support for the swash plate 18 on the drive shaft 16 at the support portion 19*a* in the swash plate center hole 19. When the radial center point of the swash plate 18 comes close to the cylinder block 12 while the swash plate 18 slides on the drive shaft 16, an inclination angle of the swash plate 18, relative to a virtual plane orthogonal to the rotation axis "L", increases.

The variable displacement compressor 10 further includes a control mechanism to automatically change the inclination angle of the swash plate 18 supported on the drive shaft 16 in response to the pressure change of the hydraulic fluid in a fluid circuit, such as a refrigerant circuit of the air conditioning system. As shown in FIG. 1, the control mechanism includes an extraction passage 35, a supply passage 36, a control valve 37 and a monitoring passage 41. The extraction passage 35 is formed in the housing assembly, through which the crank chamber 15 is fluidly communicated with the suction chamber 25. The supply passage 36 is also formed in the housing assembly, through which the crank chamber 15 is fluidly communicated with the discharge chamber 26. The control valve 37 is supported on the rear housing 13, and is arranged in the supply passage 36 to selectively open and close the supply passage 36. The monitoring passage 41 is formed in the rear housing 13, through which the control valve 37 is connected with the suction chamber 15.

The control valve 37 is a pressure sensitive valve which is actuated by the pressure change of the hydraulic fluid in the suction chamber 25 monitored through the monitoring passage 41. The control valve 37 includes a diaphragm 37*a* adapted to sense the pressure change in the suction chamber 25 through the monitoring passage 41, and a valve element 37*b* operatively connected to the diaphragm 37*a*.

According to the control mechanism having the above structure, the aperture size of the supply passage 36 is adjusted by the control valve 37 so as to vary the internal pressure of the crank chamber 15, and thereby the difference between the pressure in the crank chamber 15 acting on the front sides (the left sides in the figure) of the pistons 23 and the pressure in the cylinder bores 12*a* acting on the rear sides (the right sides in the figure) of the pistons 23 is regulated. Such a pressure difference between the crank chamber 15 and the cylinder bores 12*a* affects the reciprocating motion or the stroke of the pistons 23. As a result, the inclination angle of the swash plate 18 supported on the drive shaft 16 is changed, the stroke of each piston 23 is varied, and thereby the compression ratio of the hydraulic fluid is optimized or the displacement of the compressor 10 is adjusted.

During the operation of the compressor 10, the internal pressure in the crank chamber 15 and in the discharge chamber 26 are normally higher than the internal pressure in the suction chamber 25. If a load on the hydraulic fluid in the fluid circuit, such as the refrigerant in the refrigerant circuit, is enhanced so that the pressure of the hydraulic fluid in the suction chamber 25 rises above a set value, the control valve 37 is actuated so as to reduce the aperture size of the supply passage 36. Thereby, the internal pressure in the crank chamber 15 is relieved through the extraction passage 35 communicating with the suction chamber 25. As a result, the reciprocating motions of the pistons 23 are facilitated and, consequently, the swash plate 18 is shifted in a sliding manner on the drive shaft 16 to increase the inclination angle of the swash plate 18, while the support portion 19*a* of the swash plate 18 is urged onto and slidably engaged with the outer circumferential surface of the shaft 16.

During this shifting motion, the joint mechanism 20 operates in such a manner that the ends 44*a* of the guide pin 44 are moved along the guide holes 45*a* of the support arms 45 in a direction away from the rotation axis "L", and the swash plate 18 is tilted or rotated about the lateral axis "S" of the arcuate surface of the support portion 19*a* in a clockwise direction in the drawings. In this manner, the swash plate 18 is shifted toward a position shown in FIG. 2A wherein the inclination angle of the swash plate 18 is maximum, and the stroke of each piston 23 is increased accordingly. Consequently, the displacement of the compressor 10 increases, and the pressure of the hydraulic fluid in the fluid circuit, or in the suction chamber 25, drops toward the set value.

On the other hand, if a load on the hydraulic fluid in the fluid circuit is decreased so that the pressure of the hydraulic fluid in the suction chamber 25 drops below the set value, the control valve 37 is actuated so as to enlarge the aperture size of the supply passage 36. Thereby, the internal pressure in the crank chamber 15 is increased due to the supply of the hydraulic fluid through the supply passage 36. As a result, the reciprocating motions of the pistons 23 are hampered and, consequently, the swash plate 18 is shifted in a sliding manner on the drive shaft 16 to decrease the inclination angle of the swash plate 18, while the support portion 19*a* of the swash plate 18 is urged onto and slidably engaged with the outer circumferential surface of the shaft 16.

During this shifting motion, the joint mechanism 20 operates in such a manner that the ends 44*a* of the guide pin 44 are moved along the guide holes 45*a* of the support arms 45 in a direction toward the rotation axis "L", and the swash plate 18 is tilted or rotated about the lateral axis "S" of the arcuate surface of the support portion 19*a* in a counterclockwise direction in the drawings. In this manner, the swash plate 18 is shifted toward a position shown in FIG. 3A wherein the inclination angle of the swash plate 18 is minimum, and the stroke of each piston 23 is reduced accordingly. Consequently, the displacement of the compressor 10 decreases, and the pressure of the hydraulic fluid in the fluid circuit, or in the suction chamber 25, rises toward the set value.

As illustrated in FIG. 2A, during the operation of the compressor 10, each piston 23 is subjected to a compressive load "K" due to the compression of the hydraulic fluid or refrigerant gas, and the compressive load "K" is applied to the inner wall surfaces of the guide holes 45*a* of the support arms 45, on a front side (or a left side in the figure) away from the swash plate 18, through the shoes 24, the swash plate 18, the swing arm 43 and the guide pin 44. Then, the reaction force "F" is applied to the guide pin 44 from the inner wall surfaces of the guide holes 45*a*. In this respect, the guide holes 45*a* extend obliquely relative to the axis "L" of the drive shaft 16 as already described. Therefore, the reaction force "F" applied to the guide pin 44 acts to bias the swash plate 18 in a direction "f" toward the joint mechanism 20 in relation to the drive shaft 16.

When the displacement of the compressor 10 is adjusted to be decreased and thus the compression ratio of the hydraulic fluid is decreased, the compressive load "K" is reduced and the biasing force applied in the direction "f" is reduced accordingly. The reduction of the biasing force in the direction "f" may cause difficulties in keeping the support portion 19*a* of the swash plate 18 contacting the drive shaft 16. To eliminate this inconvenience, the swash plate 18 is structured so that the center of gravity thereof is displaced toward the joint mechanism 20 from the rotation axis "L", so as to supplement the reduction of the biasing force during the lower displacement condition of the compressor 10.

The center of gravity of the swash plate 18 is displaced mainly due to the eccentric location of swing arm 43 and guide pin 44 in relation to the rotation axis "L". The eccentric location of swing arm 43 and guide pin 44 can be compensated by forming a counter weight 18*a* on the swash plate 18 at the opposite side of the swing arm 43 in relation to the rotation axis "L". In the illustrated embodiment, the counter weight 18*a* is positioned and dimensioned so that the center of gravity of the swash plate 18 is little displaced toward the joint mechanism 20 from the rotation axis "L", so as to slightly unbalance the rotation of the swash plate 18. Accordingly, the rotating swash plate 18 is apt to be biased toward the joint mechanism 20 on the drive shaft 16, due to unbalanced centrifugal force applied in larger to a part of the swash plate 18 on which the swing arm 43 is formed.

In this manner, during the operation of the compressor 10, the inner wall surface of the center hole 19 of the swash plate 18 is continuously urged at the support portion 19*a* onto the outer circumferential surface of the drive shaft 16. Consequently, a friction force is caused between the drive shaft 16 and the support portion 19*a* in such a direction as to make it difficult for the swash plate 18 to smoothly shift or tilt on the drive shaft 16, during the operation for adjusting the displacement of the compressor 10.

Figure 2B:
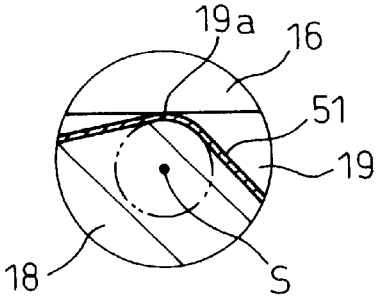
FIG. 2B is a further enlarged view showing a portion indicated by a circle II of FIG. 2A.
Figure 3B:
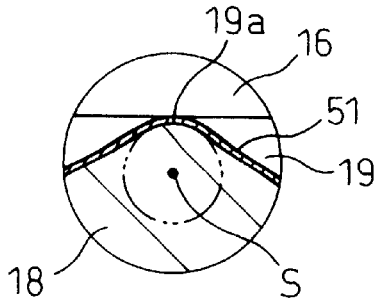
FIG. 3B is a further enlarged view showing a portion indicated by a circle III of FIG. 3A.

The variable displacement compressor 10 according to the present invention further includes a friction reducing means to reduce the friction force caused between the drive shaft 16 and the support portion 19*a*, during the operation for adjusting the displacement of the compressor 10. As shown in FIGS. 2B and 3B, the friction reducing means of the illustrated embodiment includes a coating layer 51 provided on the inner wall surface of the center hole 19 of the swash plate 18, including the arcuate surface of the support portion 19*a*. The coating layer 51 serves to lower the coefficient of friction of the surface of the support portion 19*a* abutted to the outer circumferential surface of the drive shaft 16, in comparison with the coefficient of friction of the machined arcuate surface of the support portion 19*a*. Consequently, the friction force caused between the drive shaft 16 and the support portion 19*a*, during the operation for adjusting the displacement of the compressor 10, is effectively reduced, and thereby it is made possible for the swash plate 18 to smoothly shift or tilt on the drive shaft 16.

The coating layer 51 may be formed by plating the inner wall surface of the center hole 19 of the swash plate 18 with, e.g., tin. Alternatively, the coating layer 51 may be formed by coating the inner wall surface of the center hole 19 with, e.g., fluorine-contained polymers such as polytetrafluoroethylene (PTFE). Moreover, the coating layer 51 may be formed entirely on the inner wall surface of the center hole 19, or may be formed locally on the arcuate surface of the support portion 19*a*.

As apparent from the above description, the variable displacement compressor 10 according to the present invention produces the remarkable effects as follows:

(I) The swash plate 18 can smoothly shift or tilt on the drive shaft 16 during the operation for adjusting the displacement of the compressor 10. Consequently, the response of the adjustment of the compressor displacement can be significantly improved. If the compressor 10 is incorporated into the air conditioning system of a vehicle, the control of the temperature in a passenger compartment is effectively improved.

(II) The swash plate 18 is supported on and guided along the drive shaft 16 through the slidable support due to the support portion 19*a* in the center hole 19. Therefore, the number of parts used for the slidable support between the drive shaft 16 and the swash plate 18 is reduced. As a result, the production cost is decreased and stock management is facilitated.

(III) When the coating layer 51 is provided on the entire inner wall surface of the center hole 19 of the swash plate 18, including the arcuate surface of the support portion 19*a*, the coating layer 51 can be readily and surely formed on the support portion 19*a*, in comparison with a local formation of the coating layer 51 only on the support portion 19*a*. The local formation of the coating layer 51 may be a troublesome work because of the requirement for accurately locating the coating layer 51 on the support portion 19*a* formed at the inner position of the relatively narrow center hole 19. Also, when the coating layer 51 is formed on the entire surface of the center hole 19, the coefficient of friction of the entire surface of the center hole 19 is lowered. Therefore, if the swash plate 18 is unsteadily shifted during the adjustment of the compressor displacement and thereby a surface part other than the arcuate surface of the support portion 19*a* is inadvertently abutted to the outer circumferential surface of the drive shaft 16, the swash plate 18 can smoothly shift or tilt on the drive shaft 16 without being hampered by such an inadvertent abutment.

While the invention has been particularly shown and described with reference to preferred embodiments thereof, it will be understood by those skilled in the art that various changes and modifications may be made without departing from the spirit and scope of the following claims.

We claim:

1. A variable displacement compressor comprising:

a housing assembly having at least one cylinder;

a drive shaft rotatably supported in said housing assembly;

a cam plate arranged in said housing assembly and provided at a generally center thereof with a through hole, through which said drive shaft extends, said cam plate being provided in a wall surface of said through hole with a support portion abutted onto said drive shaft to establish a slidable support for said cam plate on said drive shaft;

a joint mechanism for connecting said cam plate with said drive shaft to rotate said cam plate together with said drive shaft, said joint mechanism permitting said cam plate to shift on said drive shaft to change an inclination of said cam plate relative to said drive shaft;

at least one piston respectively accommodated in said at least one cylinder and engaged with said cam plate to be reciprocated in said cylinder due to a rotation of said cam plate;

a control mechanism for changing said inclination of said cam plate on said drive shaft to adjust a compressor displacement; and a friction reducing means for reducing friction force caused between said drive shaft and said support portion of said cam plate during an operation for adjusting said compressor displacement, wherein said friction reducing means includes a coating layer provided on said wall surface of said through hole of said cam plate to coat said support portion therewith, said coating lowering a coefficient of friction of said support portion abutted onto said drive shaft.

2. The variable displacement compressor of claim 1, wherein said coating layer has a coefficient of friction lower than that of said wall surface of said through hole.

3. The variable displacement compressor of claim 1, wherein said coating layer is formed by plating said wall surface of said through hole.

4. The variable displacement compressor of claim 1, wherein said coating layer is formed by coating said wall surface of said through hole with fluorine-contained polymers.

5. The variable displacement compressor of claim 1, wherein said coating layer is formed substantially entirely on said wall surface of said through hole.

6. The variable displacement compressor of claim 1, wherein said coating layer is formed locally on said support portion.

7. The variable displacement compressor of claim 1, wherein said support portion of said cam plate includes a generally arcuate surface extending about an axis located opposite to said joint mechanism in relation to said drive shaft.

8. The variable displacement compressor of claim 1, wherein said drive shaft includes a flange portion rotating together with said drive shaft in said housing assembly, and wherein said joint mechanism includes an arm extending form said cam plate to be slidably and pivotably engaged with said flange portion of said drive shaft and a guide member for guiding said arm on said flange portion in a direction permitting said cam plate to change said inclination on said drive shaft.

9. The variable displacement compressor of claim 8, wherein said arm includes a guiding projection projecting from said arm, and wherein said flange portion includes a guiding recess disposed frontward or backward of said arm in view of a rotation direction of said cam plate for receiving and guiding said guiding projection.

* * * * *